United States Patent [19]

Comeau et al.

[11] Patent Number: 4,919,185

[45] Date of Patent: Apr. 24, 1990

[54] HEADRAIL AND BRACKET COMBINATION FOR SUPPORTING BLINDS

[75] Inventors: Paul E. Comeau; John M. DeBeau; Anthony Torti, all of Warwick, R.I.

[73] Assignee: Kenney Manufacturing Company, Warwick, R.I.

[21] Appl. No.: 170,936

[22] Filed: Mar. 21, 1988

[51] Int. Cl.[5] ..... E06B 9/38

[52] U.S. Cl. ..... 160/178.1; 160/902

[58] Field of Search ..... 160/168.1, 178.1, 902

[56] References Cited

U.S. PATENT DOCUMENTS

| | | | |
|---|---|---|---|
| 1,356,675 | 10/1920 | Weir . | |
| 1,553,132 | 9/1925 | Bertrand . | |
| 1,805,611 | 5/1931 | Burns . | |
| 1,822,890 | 9/1931 | Heymer . | |
| 1,845,857 | 2/1932 | Ward . | |
| 1,917,416 | 7/1933 | Zingg . | |
| 1,992,148 | 2/1935 | Hammer | 156/17 |
| 2,060,720 | 11/1936 | Beauchamp | 16/94 |
| 2,138,502 | 11/1938 | Nordstrom, Jr. et al. | 156/17 |
| 2,203,372 | 6/1940 | Trammell | 156/17 |
| 2,247,260 | 6/1941 | Stone | 160/168.1 X |
| 2,281,043 | 4/1942 | Nelson | 156/17 |
| 2,367,322 | 1/1945 | Wright et al. | 248/262 |
| 2,674,432 | 4/1954 | Lorentzen | 248/264 |
| 2,698,727 | 1/1955 | Rutledge | 248/264 |
| 2,808,222 | 10/1957 | Wassyng et al. | 248/262 |
| 3,169,006 | 2/1965 | Lorentzen et al. | 248/262 |
| 4,141,525 | 2/1979 | Miller | 248/251 |
| 4,224,974 | 9/1980 | Anderson et al. | 160/178 |
| 4,235,406 | 11/1980 | Vecchiarelli | 160/902 X |
| 4,531,563 | 7/1985 | Nilsson | 160/168.1 |
| 4,607,677 | 8/1986 | Comeau | 160/902 X |
| 4,802,644 | 2/1989 | Oskam | 160/902 |

FOREIGN PATENT DOCUMENTS

| | | | |
|---|---|---|---|
| 13172 | of 1892 | United Kingdom | 160/902 |
| 915588 | 1/1963 | United Kingdom . | |
| 1014927 | 12/1965 | United Kingdom . | |

*Primary Examiner*—Blair M. Johnson

*Attorney, Agent, or Firm*—Richard A. Inz; Mark D. Rowland

[57] ABSTRACT

A headrail and bracket combination is provided in which the headrail comprises a main body portion in the form of a U-shaped channel the forward wall of which is suspended from a top plate of the bracket and also restrained against forward motion, and the rear wall of the main body is supported by a rear plate of the bracket, the bracket being adapted for mounting on a window frame. An end plate is also provided for the bracket for end mounting, which end plate can be removed from view either by breaking it off or by bending it backwardly out of sight.

21 Claims, 1 Drawing Sheet

FIG. 1
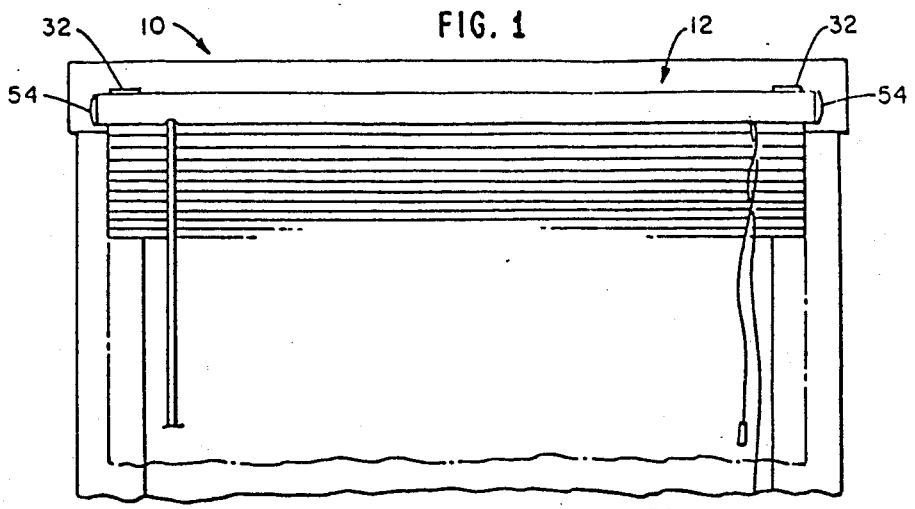
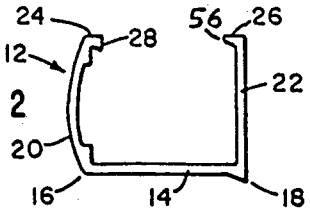
FIG. 2
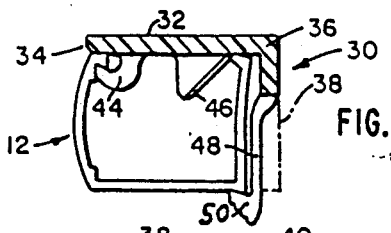
FIG. 3
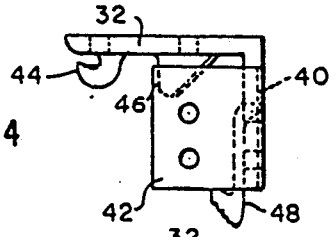
FIG. 4
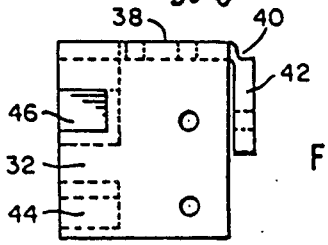
FIG. 5
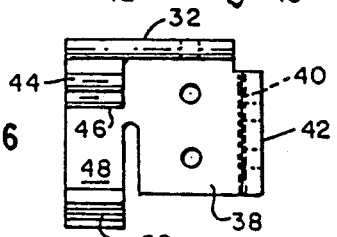
FIG. 6
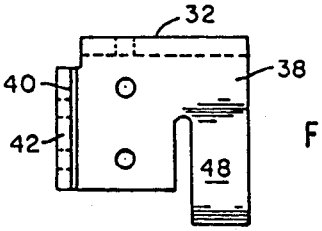
FIG. 7
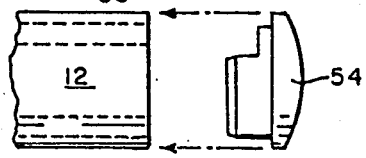
FIG. 8
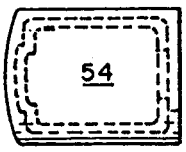
FIG. 9

HEADRAIL AND BRACKET COMBINATION FOR SUPPORTING BLINDS

FIELD OF THE INVENTION

This invention relates to supports for blinds and more particularly to a headrail and bracket combination for mounting and supporting a blind covering an opening such as a window. More particularly it relates to a headrail and bracket combination for horizontal slat-type blinds often referred to as venetian blinds.

BACKGROUND OF THE INVENTION

Presently existing headrails for venetian blinds usually are made from a U-shaped channel which is mounted in a window opening by attachment either to the face of the window frame, or by an end mount to the inner walls of the window casing, or by an overhead mount to the upper wall of the casing or to the ceiling adjacent to the window. In order to provide means for mounting the headrail in any one of these three ways, cup-shaped brackets are provided which fit onto the end of the headrail and which have screw holes in them positioned for each of the three mounting connections, and adapted also to fit around the headrail so as to support it from below and to prevent it from tilting.

Among the drawbacks of such conventional headrails and brackets are that the brackets present an unattractive enlarged portion at each end of the headrail, and in cases where the headrail is mounted on the face of the window frame, the ends of the brackets present a view of unsightly screw holes. In addition, the draw cords and slat adjusting mechanisms employed for such headrails are brought out at an angle to the front of the headrail through the front face thereof. As a result, if a smooth and clean appearance is desired for the face of the headrail, it has been necessary to attach an extra valance strip along the front face of the headrail. This has required both additional material costs and the requirement of carrying extra inventory.

It is, therefore, an object of the invention to provide a headrail and bracket combination for blinds in which the brackets are adapted for mounting in any one of the three conventional positions, and which at the same time avoids presenting to view enlarged end brackets or screw holes. An additional object is to provide a headrail and bracket combination which provides a smooth, substantially uninterrupted surface for the face and ends of the headrail and, thereby, avoids the need for a valance strip, and provides a reduction of materials and inventory requirements.

BRIEF DESCRIPTION OF THE INVENTION

These and other objects of the invention are accomplished in an embodiment selected for purposes of illustration only, in which the headrail comprises a U-shaped channel main body portion having a horizontal bottom wall bordered by longitudinally extending front and rear edges. Front and rear walls extend upwardly from the front and rear edges of the bottom wall each having longitudinally extending upper edges. The upper edge of the front wall is provided with a rearwardly extending lip. The brackets for supporting the main body portion of the headrail comprise a top plate having a front and rear edge, and a rear plate having an end edge, said rear plate extending downwardly from the rear edge of the top plate. In addition, an end plate is provided extending forward from the end edge of the rear plate. The plates are provided with screw holes for attachment respectively to the face of the window frame for the rear plate, the inside of the window casing for the end plate, and to an overhead surface or ceiling for the top plate. The top plate is provided with means on its under surface for fitting under the lip on the upper edge of the front wall of the main body portion for supporting said front wall. In addition, a ramp or wedge means is provided on the under surface of the top plate for engaging the upper inside edge of the rear wall of the main body portion and for urging said upper edge rearwardly when said lip is engaged with said front wall support means and said main body portion is pivoted upwardly. Further means are provided near the lower part of the rear plate for engagement under the rear edge of said bottom wall in supporting relation when said main body portion is pivoted upwardly against said ramp means to a substantially horizontal position.

It is a feature of the invention that the main body portion is supported with only the front end of the top plate and the rear support means being visible from the front of the headrail.

In addition, the headrail is provided with end caps which fit into the respective ends of the main body portion so as to present a clean, smooth, uninterrupted appearance at the ends of the headrail, and the end plate of the bracket is connected to the rear plate by a section of reduced thickness so that, when it is made of a relatively brittle material such as ABS (acrylonitrile butadiene styrene), it can readily be broken off (and thereby removed from view) in cases where the headrail is mounted to the face of the window frame or to an overhead surface. Alternatively, the end plate of the bracket may be made of more flexible material such as polypropylene and connected to the rear plate by a reduced thickness but flexible section so that it can be readily bent backwardly out of view when not needed, or so that it can be used to mount the bracket on a surface which is at an angle. Further, with brackets of this configuration, it is possible to provide access for the draw cords and slat adjusting means without more than minor interruption of the lines of the front face of the headrail. Accordingly, the desired "valance" appearance of the assembly is accomplished with both a reduction in materials and inventory requirements, and with greater convenience to the user during installation, than the conventional valance.

BRIEF DESCRIPTION OF THE DRAWINGS.

An embodiment of the invention selected for purposes of illustration only is shown in the accompanying drawings in which:

FIG. 1 is a view from the front of the headrail and bracket combination of the invention supporting a venetian blind on a window frame, shown using the outside mounting option, FIG. 2 is a view in end elevation of the U-shaped main body portion of the headrail, FIG. 3 is a view in end elevation of the bracket of the invention with the end plate removed to expose the interior and with the main body portion indicated in dotted lines in the locked position, FIG. 4 is an end view of the bracket, FIG. 5 is a top view of the bracket, FIG. 6 is a front view of the bracket with the end plate attached, FIG. 7 is a view in rear elevation of the bracket, FIG. 8 is a view in front elevation of an end cap, and FIG. 9 is a view in end elevation of the headrail with end cap inserted.

DETAILED DESCRIPTION OF THE INVENTION

An embodiment of the invention selected for purposes of illustration is adapted for mounting on a window frame 10 as shown in FIG. 1. It comprises a headrail indicated generally at 12 of U-shaped configuration with a bottom wall 14 having front and rear longitudinally extending edges 16, 18. A front wall 20 extends upwardly from the front edge 16 and a rear wall 22 extends upwardly from rear edge 18. Front wall 20 terminates at an upper edge 24 and rear wall 22 terminates at an upper edge 26. Front wall 20 is also provided with a rearwardly extending lip 28. The headrail is preferrably fabricated as a unitary extrusion of high resistance polyvinyl chloride, but other material such as cold rolled steel is also suitable.

Brackets indicated generally at 30 are provided to support each end of the headrail 12. They are adapted to support either the right hand or the left hand end of the headrail. Only the right hand bracket will be described because the left hand bracket is the same except in mirror image. It comprises a top plate 32 having a front and a rear edge 34, 36, and a rear plate 38 extending downwardly from the rear edge 36 of the top plate 32. The rear plate has an end edge 40. In addition an end plate 42 is provided extending forwardly from the end edge 40 of the rear plate 38. The connection between the end plate 42 and the rear plate 38 has a relatively narrow cross-section to facilitate breaking same off in cases where the bracket is made of relatively brittle material such as ABS and the headrail is mounted onto the face of the window frame or on an overhead surface such that the end plate 42 would be superfluous. Alternatively, the bracket may be made of a more flexible polypropylene such that the end plate 42 can be bent backwardly out of sight, or used for mounting to a surface at an angle.

The top plate 32 is provided on its forward underneath surface with a hook shaped front wall support means 44 which is adapted to hook under and support lip 28 of front wall 20. Top plate 32 is also provided with a ramp means 46 on its under surface near the rear edge thereof for engaging the upper edge 26 of the rear wall 22 of the main body portion 12, and for urging upper edge 26 rearwardly when lip 28 is engaged with hook element 44, and the main body portion 12 is pivoted upwardly about hook element 44 as the pivot. When this is done, the rearward urging of edge 26 serves to pull lip 28 into tight and secure engagement over hook element 44. Bracket 30 is also provided with a rear wall support means comprising an arm 48 extending downwardly from the upper part of rear plate 38, and terminating at its lower extremity with a forwardly extending ledge element 50. These latter elements are dimensioned so that when the main body portion 12 is pivoted upwardly about hook element 44 as a pivot point, and as rear edge 26 engages ramp element 46 and is urged rearwardly thereby, rear wall 22 pushes against ledge element 50, and when rear edge 26 has seated fully against ramp 46, rear wall 22 rides above ledge element 50 so that ledge element 50 springs out to a position under rear edge 18 of bottom wall 14. This is referred to as being "in the locked position". The head rail main body portion 12 will then remain in the locked position until ledge element 50 is pushed to the rear sufficiently to free rear wall 22, at which point the head rail main body portion 12 can be pivoted downwardly to remove it from the bracket 30.

It will be noted that the main body portion 12 is supported by the bracket solely by hook 44 and ledge element 50 and that end plate 42 does not contribute to that support. Thus, end plate 42 can be removed and the remaining components of bracket 30 can be used as a center support in cases where a long main body portion may require same.

In order to increase the resistance to sliding between the main body portion 12 and the bracket 30, a pointed, forwardly extending lip 56 may be provided on upper edge 26 of rear wall 22, and ramp 46 may be provided with a serrated surface against which the lip 56 will engage.

In order to provide a smooth and decoratively pleasing appearance for the end of the headrail, when it is mounted on the face of the window frame or to an overhead surface, an end cap 54 is provided, dimensioned to fit into the open end of the main body portion 12 where it will be cemented to the forward wall 20 and the bottom wall 14, leaving the rear wall 22 free to yield relative thereto under the spring force of pushing the main body portion 12 into the locked position. In addition it will be noted that, with the bracket and support combination which bears the full weight of the headrail on the lip 28 of the upper edge 24 of the front wall 20, and on ledge 50 at the rear edge 18 of bottom wall 14, the front wall 20 may be given a rounded or other decorative contour. In addition, the pull cords for the blind and the slat adjusting element can be installed either in the bottom wall 14 entirely or with only a small interruption of the continuous surface of front wall 20 along the lower forward edge 16 of bottom wall 14. Accordingly, a headrail and bracket combination is provided which performs all of the necessary functions of headrail and at the same time presents a sufficiently clean, smooth and uninterrupted surface to obviate the necessity for the application of a valance strip.

Having thus described an illustrative embodiment of the invention, various modifications thereof will now be apparent to those skilled in the art. For example, the lower edge of front wall 20 may be extended either downwardly or upwardly and/or horizontally for decorative purposes or to hide top plate 32 or ledge 50 from view from the front or to make additional room for the pull cords and slat adjusting mechanisms. In addition, the precise form of supporting the front wall may be varied to include mating hook elements in place of lip 28 and hook 44 such that, when engaged they will hold the main body portion against forward motion unless lifted. In such a variation, the locking of the rear wall against forward motion can be dispensed with. Further, the forwardly extending ledge 50 of arm 48 need not extend under bottom wall 14, but instead can support the rear wall 22 by providing a ledge extending longitudinally of the main body on the rear surface of rear wall 22, countersunk so as to interlock with the ledge element 50 and so that dismounting the main body from the bracket is accomplished by first moving it upwardly and then forwardly. An advantage of the latter arrangement is that nothing is visible along the under surface of the rear of the main body. It will be further noted that when the end plate 42 is either broken off or bent to the rear, the bracket may then be mounted inwardly of the end of the main body, thereby further removing the bracket from view. Accordingly, in view of these apparent alternatives, it is not intended to confine the invention to the precise form herein shown, but to measure it only in term of the appended claims.

I claim:

1. A headrail and mounting bracket combination for attachment to a window opening and for supporting a covering for said window, comprising:

an elongated, hollow, U-shaped main body portion having a horizontal bottom wall having longitudinally extending front and rear edges;

a front wall and a rear wall for said main body portion, said front and rear walls standing up respectively from the front and rear edges of said bottom wall, and each having longitudinally extending upper and lower edges;

a one piece bracket for supporting at least a part of said main body portion, comprising a top plate having a front and a rear edge, a rear plate extending downwardly from the rear edge of said top plate, and means associated with each of said plates for attachment to said window opening;

means associated with the top plate of said bracket for restricting said rear wall of said main body portion from forward motion when pivoted upwardly into said bracket; and spring means associated with the rear plate of said bracket for clampingly engaging the lower edge of the rear wall of said main body portion in a locked position when the train body portion is so restricted against forward motion.

2. A headrail and mounting bracket combination for attachment to a window opening and for supporting a covering for said window, comprising:

an elongated, hollow, U-shaped main body portion having a horizontal bottom wall having longitudinally extending front and rear edges;

a front wall and a rear wall for said main body portion, said front and rear walls standing up respectively from the front and rear edges of said bottom wall, and each having longitudinally extending upper edges;

a one piece bracket for supporting at least a part of said main body portion, comprising a top plate having a front and a rear edge, a rear plate extending downwardly from the rear edge of said top plate, and means associated with each of said plates for attachment to said window opening;

ramp means associated with the under surface of said top plate for engaging the upper edge of the rear wall of said main body portion and for urging said upper edge rearwardly when said main body portion is pivoted upwardly into a locked position; and rear wall latch means associated with said rear plate for clampingly engaging the rear edge of said bottom wall in locking relation when said main body portion is pivoted upwardly against said ramp means beyond a predetermined position.

3. The headrail and bracket combination of claim 2, further comprising means on said ramp means for resisting relative motion between said main body portion and said bracket when said rear plate is in engagement with said ramp means.

4. The headrail and bracket combination of claim 2, wherein said bracket further comprises an end plate.

5. The headrail and bracket combination of claim 4, wherein said end plate is connected to said rear plate by a weakened portion to facilitate removal of said end plate from view when desired.

6. The headrail and bracket combination of claim 4, wherein said bracket is made of frangible material.

7. The headrail and bracket combination of claim 4, wherein said bracket is made of stiff but flexible material.

8. The headrail and bracket combination of claim 2 further comprising an end cap adapted to be secured into an end of said main body portion such that the rear wall of said main body portion is free to yield relative to the forward and bottom walls when said main body portion is pivoted upwardly against said ramp means.

9. The headrail and bracket combination of claim 2, wherein said headrail further comprises a decorative surface on an outer face of said front wall.

10. The headrail and bracket combination of claim 2, wherein said rear wall latch means comprises a resilient arm connected to said rear plate having a forwardly extending ledge at its lower extremity for hooking under the rear edge of the bottom wall of the main body portion in locking relation for forcing said upper edge of said rear wall of said main body portion against said ramp means.

11. The headrail and mounting bracket combination of claim 2, further comprising:

a rearwardly extending lip on the upper edge of said front wall; and means associated with said top plate for engaging said rearwardly extending lip on the upper edge of said front wall.

12. The headrail and mounting bracket combination of claim 1, further comprising:

means associated with said top plate of said bracket for suspending said front wall; and wherein said upper edge of said front wall of said main body portion comprises means for engaging said suspending means.

13. The headrail and bracket combination of claim 1, wherein said restricting means operates to restrict forward motion of the rear wall by urging the upper edge of the rear wall of said main body portion rearwardly.

14. The headrail and bracket combination of claim 12, wherein said restricting means creates a downward force on the rear wall of said main body portion when urging the rear wall rearwardly, and wherein said engaging means restricts downward motion of the rear wall, such that the rear wall is restricted from upward and downward motion when in the locked position.

15. The headrail and bracket combination of claim 14, wherein said engaging means comprises a movable arm extending from the rear plate of said bracket, said arm having an element disposed to engage the rear edge of the bottom wall of said main body portion when said main body portion is in the locked position.

16. The headrail and bracket combination of claim 14, wherein said engaging means comprises a movable arm extending from the rear plate of said bracket, said arm having a first element disposed to engage a corresponding second element associated with the rear wall of said bracket such that the first and second elements engage above the rear edge of the bottom wall of said main body portion when said main body portion is in the locked position.

17. The headrail and bracket combination of claim 1, wherein said engaging means comprises a movable arm extending from the rear plate of said bracket, said arm having an element disposed to engage the rear edge of the bottom wall of said main body portion when said main body portion is in the locked position.

18. The headrail and bracket combination of claim 1, wherein said engaging means comprises a movable arm extending from the rear plate of said bracket, said arm having a first element disposed to engage a corresponding second element associated with the rear wall of said bracket such that the first and second elements engage above the rear edge of the bottom wall of said main body portion when said main body portion is in the locked position.

19. A headrail and bracket combination for use in supporting a window covering, comprising:

a headrail having a main body portion including a bottom wall, a front wall and a rear wall, said bottom wall having longitudinally extending front and rear edges, the rear edge of said bottom wall having a downward projection, said front and rear walls extending upwardly respectively from the front and rear edges of said bottom wall and each having a longitudinally extending upper edge, the upper edge of said rear wall having a first forward projection;

a one piece bracket for supporting at least a part of the main body portion of the headrail, said bracket including a top plate and a rear plate extending downwardly from a rear edge of said top plate;

a first inflexible rearward projection extending from and beneath the lower surface of said top plate, said first rearward projection having a rear surface which slopes rearwardly and upwardly from a lower surface of said first rearward projection to the lower surface of said top plate, said rear surface being disposed to slidably engage and rearwardly urge the first forward projection of the upper edge of the rear wall of said main body portion when said main body portion is inserted into said bracket, the slope of the rear surface creating a downward force on the rear wall of said main body portion when said first forward projection is urged rearwardly, and the rearward urging of said first forward projection creating a secure engagement between said first rearward projection and said first forward projection; and a movable arm extending downwardly from said rear plate, said arm having a forwardly extending ledge element at its lower extremity, said ledge element being disposed to clampingly engage the downward projection extending from the rear edge of the bottom wall of the main body portion in a locked position when the main body portion is pivoted to move the bottom wall downward projection above the ledge element.

20. The headrail and bracket combination of claim 19, further comprising:

a second rear projection extending from said upper edge of said front wall;

a second forward projection extending from and beneath a lower surface of said top plate for engaging said second rearward projection.

21. The headrail and bracket combination of claim 19, wherein said bracket further comprises an end plate extending forwardly from an end edge of said rear plate, and wherein each of said top, rear and end plates has one or more holes disposed for attaching the bracket to a mounting surface.

* * * * *